US012234699B2

(12) United States Patent
Liu et al.

(10) Patent No.: US 12,234,699 B2
(45) Date of Patent: Feb. 25, 2025

(54) INNER TUBE ASSEMBLY OF DRILL TOOL AND ROPE CORING DRILL TOOL THEREOF

(71) Applicant: Guangdong Eagler Geological Equipment Technology Co., Ltd, Guangdong (CN)

(72) Inventors: Xuyong Liu, Guangdong (CN); Guanghong Deng, Guangdong (CN); Beihua Chen, Guangdong (CN)

(73) Assignee: Guangdong Eagler Geological Equipment Technology Co., Ltd, Zhuhai (CN)

( * ) Notice: Subject to any disclaimer, the term of this patent is extended or adjusted under 35 U.S.C. 154(b) by 0 days.

(21) Appl. No.: 18/209,496

(22) Filed: Jun. 14, 2023

(65) Prior Publication Data

US 2024/0218756 A1 Jul. 4, 2024

(30) Foreign Application Priority Data

Dec. 30, 2022 (CN) ..... 202211733135.X

(51) Int. Cl.
*E21B 25/02* (2006.01)
*E21B 31/20* (2006.01)
*E21B 7/00* (2006.01)

(52) U.S. Cl.
CPC ..... *E21B 25/02* (2013.01); *E21B 31/20* (2013.01); *E21B 7/00* (2013.01)

(58) Field of Classification Search
CPC ..... E21B 25/02; E21B 31/18
See application file for complete search history.

(56) References Cited

U.S. PATENT DOCUMENTS 3,103,981 A * 9/1963 Harper ..... E21B 25/02 175/246
3,225,845 A * 12/1965 Koontz ..... E21B 25/02 175/246
3,305,033 A * 2/1967 Pickard ..... E21B 25/02 175/246
3,333,647 A * 8/1967 Karich ..... E21B 25/02 175/247
3,461,981 A * 8/1969 Casper ..... E21B 25/02 175/246

(Continued)

OTHER PUBLICATIONS

Office Action dated Jul. 29, 2024 for Corresponding Australian Application No. 2023203847.

(Continued)

*Primary Examiner* — David Carroll

(57) ABSTRACT

Provided is an inner tube assembly of a drill includes an inner tube assembly upper part and an inner tube assembly lower part which are rotatable relatively and connected together through a shaft and a single action mechanism including a bearing block and a thrust ball bearing, a bearing is built into a shaft part of the bearing block, the shaft is connected in the thrust ball bearing of the bearing block, the bearing block is provided with a sealing ring seat sealed with the shaft. A rope coring drill tool including the inner tube assembly of drill tool described above is also provided. The present disclosure can avoid entry of drilling fluid into the bearing, effectively protect the bearing and safeguard single action performance of the drill tool.

20 Claims, 5 Drawing Sheets

(56) References Cited

U.S. PATENT DOCUMENTS

| | | | | | |
|---|---|---|---|---|---|
| 3,485,310 | A | * | 12/1969 | Milosevich | E21B 25/02 175/246 |
| 3,874,466 | A | * | 4/1975 | Fulford | E21B 25/02 175/239 |
| 3,930,679 | A | * | 1/1976 | Anderson | E21B 31/18 294/86.32 |

OTHER PUBLICATIONS

Office Action Dated Dec. 2, 2024 for Corresponding Canadian Application No. 3,204,230.

* cited by examiner

INNER TUBE ASSEMBLY OF DRILL TOOL AND ROPE CORING DRILL TOOL THEREOF

CROSS-REFERENCE TO RELATED APPLICATIONS

The present application claims priority of Chinese patent Application No. 202211733135.X, filed on Dec. 30, 2022, the entire contents of which are hereby incorporated by reference.

TECHNICAL FIELD

The present disclosure relates to the field of drilling technology, and in particular to an inner tube assembly of drill tool and a rope coring drill tool thereof.

DESCRIPTION OF THE PRIOR ART

Rope coring drilling is a drilling method to pick up the drill core within the outer tube without lifting the outer string. Currently there has been widespread application both in and outside the country. Wide applications have been made in the fields of homeland resources, metallurgy, coal, and the like.

However, the rope coring process has few applications in engineering geological survey, rare earth mineral survey, hydraulic and hydropower survey. The reason is that this type of investigational drilling has higher requirement on drill core adoption rate and drill core quality, and in particular on structurally and compositionally complex overlays, weak interlayers, hard and brittle formations, etc. that require accurate geological information through the coring, and therefore high quality is required for coring. While conventional rope coring drill tools are used more in rock formations and deep holes and less for overlays and shallow holes. The effect of single action performance between the inner tube and the outer tube of the drill tool on the coring quality is not emphasized. The use of a crude single action mechanism therefore results in an unguaranteed single action performance between the inner tube and the outer tube of the drill tool and is easy to directly impact the coring quality during the process of drilling due to a poor isolation of the single action. Especially for cases of complex structural and compositional overlays, weak interlayers, hard and brittle formations, and the like, the coring quality does not meet the relevant requirements.

The bearing of the single action mechanism of a conventional rope coring drill tool are substantially unprotected and are exposed directly to the drilling fluid in operation, and particles of rock powder carried in the drilling fluid are highly prone to bearing seizure affecting the single action performance of the drill tool and, in turn, the quality of the drill core. Especially in situations where the use of circulating mud is required or where the mud concentration is relatively high, the drill tool is jammed and loses the single action performance, which severely restricts the application of the rope coring drilling process to water conservancy and hydropower, engineering survey, rare earth mineral survey fields.

SUMMARY OF THE DISCLOSURE

An object of the present disclosure is to provide an inner tube assembly of drill tool and a rope coring drill tool thereof that avoid the drilling fluid entering the bearing during drilling, effectively protect the bearing and safeguard single action performance of the drill tool, to facilitate the promotion of the use of the rope coring drilling process in the fields of water conservancy and hydropower, engineering survey, rare earth mineral survey, and the like.

In order to achieve the above object, a technical solution provided by the present disclosure is an inner tube assembly of drill tool including an inner tube assembly upper part and an inner tube assembly lower part which are rotatable relatively and connected together through a shaft and a single action mechanism including a bearing block and a thrust ball bearing, wherein the thrust ball bearing is built into a shaft part of the bearing block, the shaft is connected to the thrust ball bearing in the bearing block, the bearing block is provided with a sealing ring seat sealed with the shaft.

For above the technical solution adopted by the present disclosure, the shaft is connected to the inner tube assembly upper part and is disposed in the bearing block via the thrust ball bearing, thereby achieving relative rotation of the inner tube assembly upper part of and the inner tube assembly lower part, the provision of the sealing ring seat on the bearing block allows for a good seal against the thrust ball bearing in the bearing block, and in actual use, prevents the entry of drilling fluid, flushing fluid and mud into the bearing, effectively protects the use of the bearing, allows for an effective isolation of the single action mechanism and ensures the single action performance of the inner tube assembly of drill tool.

For the inner tube assembly of drill tool as described above, the bearing block is provided with an upper shaft part and a lower shaft part, the thrust ball bearing includes a thrust bearing and a suspension bearing which are respectively built into the upper shaft part and the lower shaft part of the bearing block, the shaft passes through the thrust bearing and the suspension bearing which are in the bearing block and a lock nut is provided at a lower end of the shaft. The thrust bearing and the suspension bearing are used to support the rotation of the shaft, and the lock nut at the lower end of the shaft is used to lock and fix the shaft, to ensure an axial positioning of the shaft and prevent a relative movement.

For the inner tube assembly of drill tool as described above, the upper shaft part of the bearing block is provided an internal thread, and the sealing ring seat is provided with an external thread and is screwed between the upper shaft part and the shaft.

For the inner tube assembly of drill tool as described above, the lower shaft part of the bearing block is provided with an external thread to which an outer seat is screwed.

For inner tube assembly of drill tool as described above, the shaft is provided with a shaft sealing ring, the shaft is sealed with a sealing valve seat by the shaft sealing ring. The provision of the shaft sealing ring ensures the sealing between the shaft and the sealing valve seat.

For the inner tube assembly of drill tool as described above, wherein the bearing block is sealed with the sealing ring seat by a first sealing ring and is sealed with the outer seat by a second sealing ring. By means of the first sealing ring and the second sealing ring, the sealing at the threaded connection of the bearing seat with the sealing ring seat and the outer seat is effectively ensured.

For the inner tube assembly of drill tool as described above, the inner tube assembly lower portion includes an inner tube lid and a spindle, the spindle connects the outer seat with the inner tube lid, and the inner tube lid is connected with an inner tube.

For the inner tube assembly of drill tool as described above, a cap is removably provided on the inner tube lid, a lower end of the spindle passes through the cap and extends into the inner tube lid, and a compression spring is provided between the cap and a bottom end of the spindle. In the process of extracting the drill core, when the drill tool is lifted, the outer tube and the outer tube assembly are driven to moved upward, a clamping spring clamps the drill core and keeps the inner tube, the inner tube lid, the bearing block, and etc. holding stationary, the compression spring is squeezed and acts as a cushion, to protect the inner tube; during each pull, a portion of the spindle within the inner tube lid is pulled out, an inner cavity space of the inner tube lid becomes larger, so a negative pressure is created and draws the drilling fluid into the inner tube lid, and because the spindle is placed on the outer seat, the threaded connection between the outer seat and the bearing block creates a seal, the incoming drilling fluid does not enter into the bearing block and does not affect the operation of the bearing.

For the inner tube assembly of drill tool as described above, the inner tube assembly upper part includes a fishing spear mechanism, a clamping mechanism and a recovery pipe which are connected in sequence from top to bottom, the single action mechanism is connected to the clamping mechanism through the shaft.

For the inner tube assembly of drill tool as described above, the clamping mechanism includes a clamping holder and clamping tongs, the clamping holder is provided in the recovery pipe, the clamping tongs is provided in the clamping holder through an embedded spring, two wings of the clamping tongs extend out of the recovery pipe when deployed, a bottom end of the clamping holder is connected to the shaft through a clamping holder lower joint. The clamping tongs are deployed by the embedded spring and extends out of the recovery pipe, to position and fix a drill head assembly, and when the drill core is fished, the fishing mechanism is pulled up to pull the recovery pipe, so that the clamping tongs are retracted inwards to loosen, and the drill core may be fished.

For the inner tube assembly of drill tool as described above, a top end of the clamping holder lower joint is provided with a suspension ring. When the inner tube assembly of drill tool is assembled in the outer tube assembly, after the inner tube assembly of drill tool has reached a predetermined position of the outer tube assembly, the suspension ring abuts against the seat ring in the outer tube assembly, to achieve a positioning function.

For the inner tube assembly of drill tool as described above, the bottom end of the clamping holder is provided with a flushing fluid channel, the clamping holder lower joint is provided with a drilling fluid channel, and the flushing fluid channel is in communication with the drilling fluid channel, and a position message sleeve and a freely movable steel ball are provided therebetween. After the inner tube assembly of drill tool is fitted into the predetermined position in the outer tube assembly, the flushing fluid channel is blocked, the flushing fluid is forced to change the flow direction, the increase in water pressure moves the steel ball down through the position message sleeve, to cause the flushing fluid channel to open, and on the ground, the pressure of the pump gauge increases significantly and then decreases abruptly to indicate that the inner tube assembly has reached the drilling position while the steel ball passes through the position message sleeve.

Another technical solution provided by the present disclosure is a rope coring drill tool including the inner tube assembly of drill tool described above.

The rope coring drill tool as described above further includes an outer tube assembly, a drill bit and a reamer, the reamer and the drill bit are disposed at a bottom end of the outer tube assembly, the inner tube assembly of drill tool is mounted in the outer tube assembly.

For the rope coring drill tool as described above, the outer tube assembly includes an outer tube, and the reamer and the drill bit are provided at a bottom end of the outer tube.

For the rope coring drill tool as described above, the outer tube assembly includes a clamping chamber and a clamping stop head, the clamping stop head abuts against the clamping tongs of the inner tube assembly of drill tool. Once the inner tube assembly of drill tool is assembled in the clamping chamber in the outer tube assembly, the clamping tongs are deployed and abuts against a bottom end of the clamping stop head, to prevent axial displacement of the inner tube assembly of drill tool.

For the rope coring drill tool as described above, a seat ring is provided within the outer tube and the inner tube assembly of drill tool is positionally mounted onto the seat ring through the suspension ring. In particular embodiments, the inner tube assembly of drill tool connects the inner tube through the inner tube lid, and when it is assembled in the outer tube, the positioning function is achieved by positioning the suspension ring to the seat ring, and the inner tube assembly of drill tool is in place and a sweep hole drilling may be performed.

The beneficial effects achieved by the present disclosure are that: the thrust bearing and the suspension bearing that achieve single action function are mounted in the bearing block, the upper end of the bearing block is sealed by a sealing ring seat, the lower end of the bearing block is sealed by threaded connection of an outer seat, the bearings is free from contact with the drilling fluid, has stable single action and long service life and is maintenance free; the compression spring is separated from the rotating components such as the shaft, the clamping mechanism, etc., so that when under tension or compression, the incoming drilling fluid does not flow and affect single action of the bearing; the inner tube assembly of drill tool may replace the inner tube assembly of drill tool of a conventional rope coring drill tool, and flexible and convenient to use, and which facilitate the promotion of the rope coring drilling process in the fields of water conservancy and hydropower, engineering survey, rare earth mineral survey, and the like.

Figure 1:
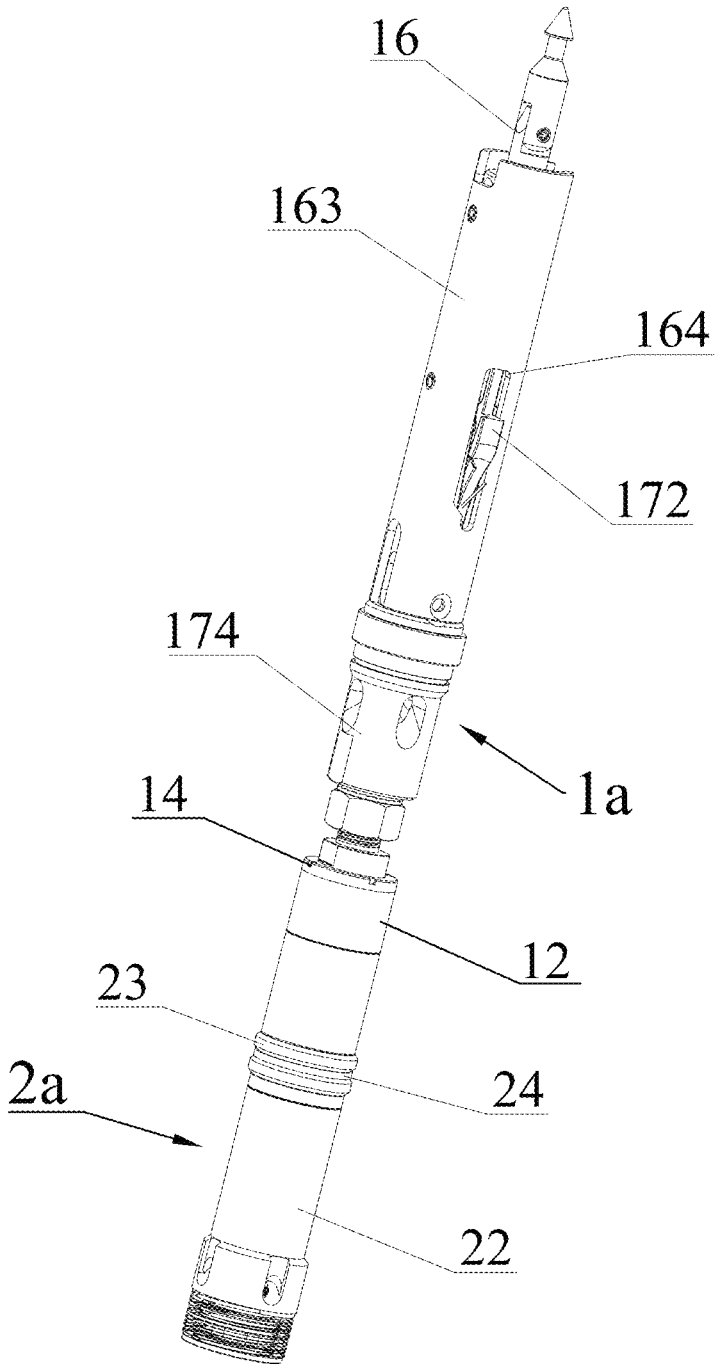
FIG. 1 is a structural schematic illustration of an inner tube assembly of drill tool in accordance with an embodiment of the present disclosure.

Description of reference numerals: inner tube assembly upper part 1*a*, single action mechanism 1, shaft 11, shaft sealing ring 111, lock nut 112, bearing block 12, first sealing ring 121, second sealing ring 122, upper shaft part 123, lower shaft part 124, thrust ball bearing 13, thrust bearing 131, suspension bearing 132, sealing ring seat 14, outer seat 15, receiving groove 151, fishing spear mechanism 16, fishing spear head 161, fishing spear seat 162, recovery pipe 163, side hole 164, clamping mechanism 17, clamping holder 171, clamping tong 172, embedded spring 173, clamping holder lower joint 174, flushing fluid channel 175, drilling fluid channel 176, position message sleeve 177, steel ball 178, suspension ring 18, inner tube assembly lower part, spindle 21, blocking nut 211, inner tube lid 22, cap 221, compression spring 222, check valve 223, location alarm rubber ring 23, shim of shutoff valve 24, inner tube 25, clamping spring seat 251, clamping spring 252, outer tube assembly 3, outer tube 31, drill bit 32, seat ring 33, clamping chamber 34, clamping stop head 35, reamer 36, centering ring 37.

DESCRIPTION OF EMBODIMENTS

The present disclosure is further described below with reference to the accompanying drawings and detailed implementation.

Figure 2:
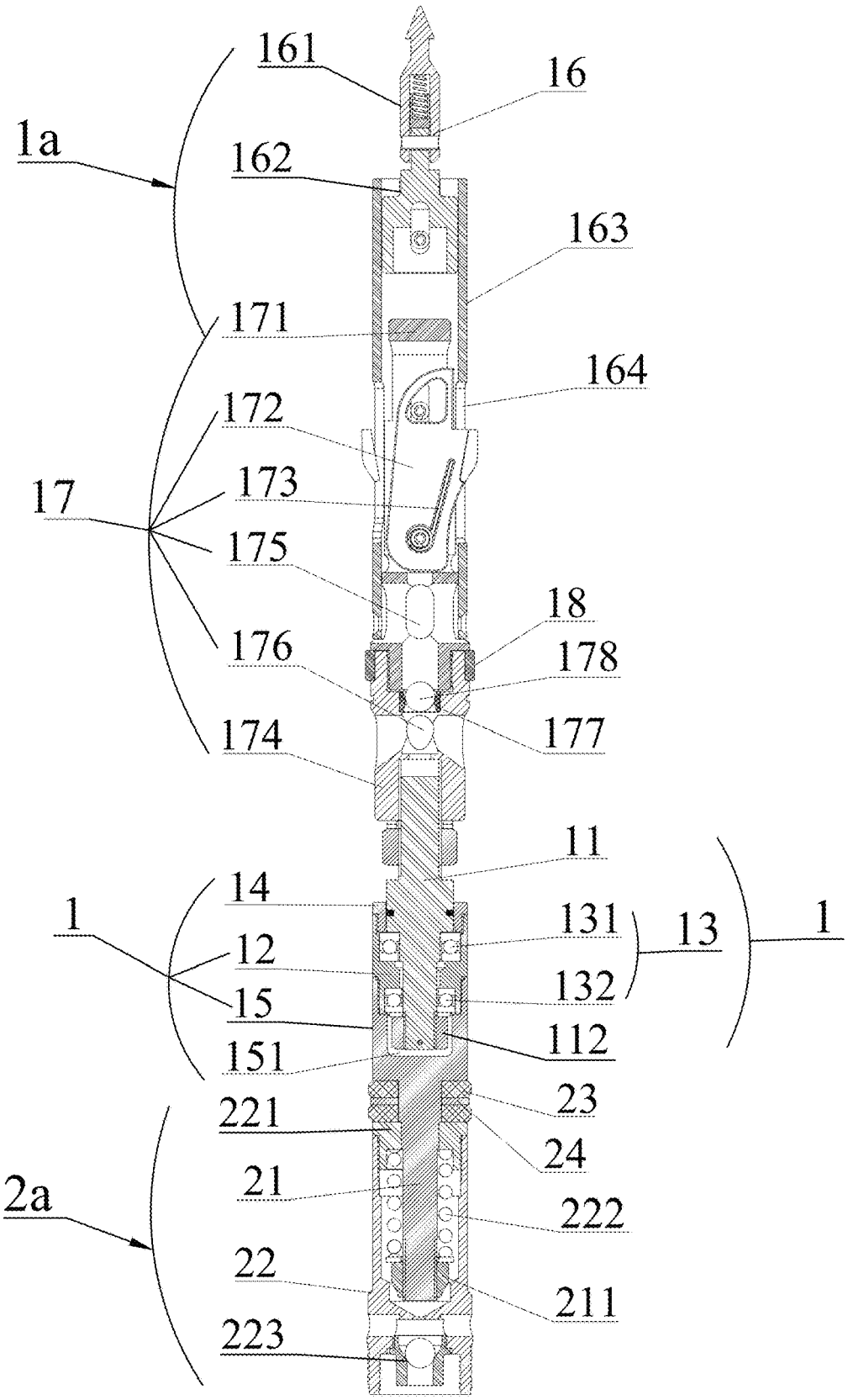
FIG. 2 is a schematic cross-sectional illustration of an inner tubular assembly of drill tool in accordance with an embodiment of the present disclosure.
Figure 3:
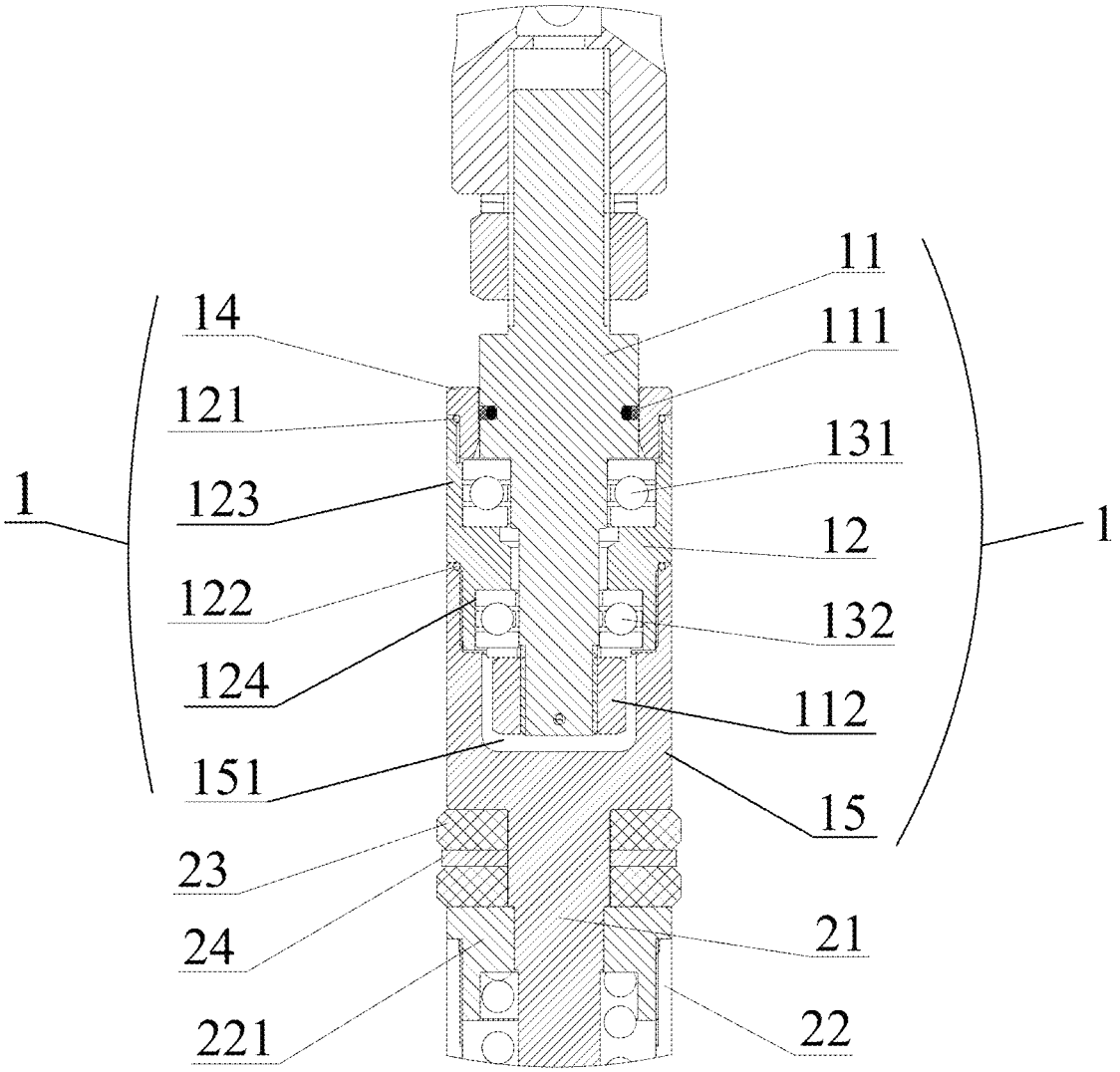
FIG. 3 is an enlarged view of a partial structure of an inner tube assembly of an embodiment of the present disclosure.
Figure 4:
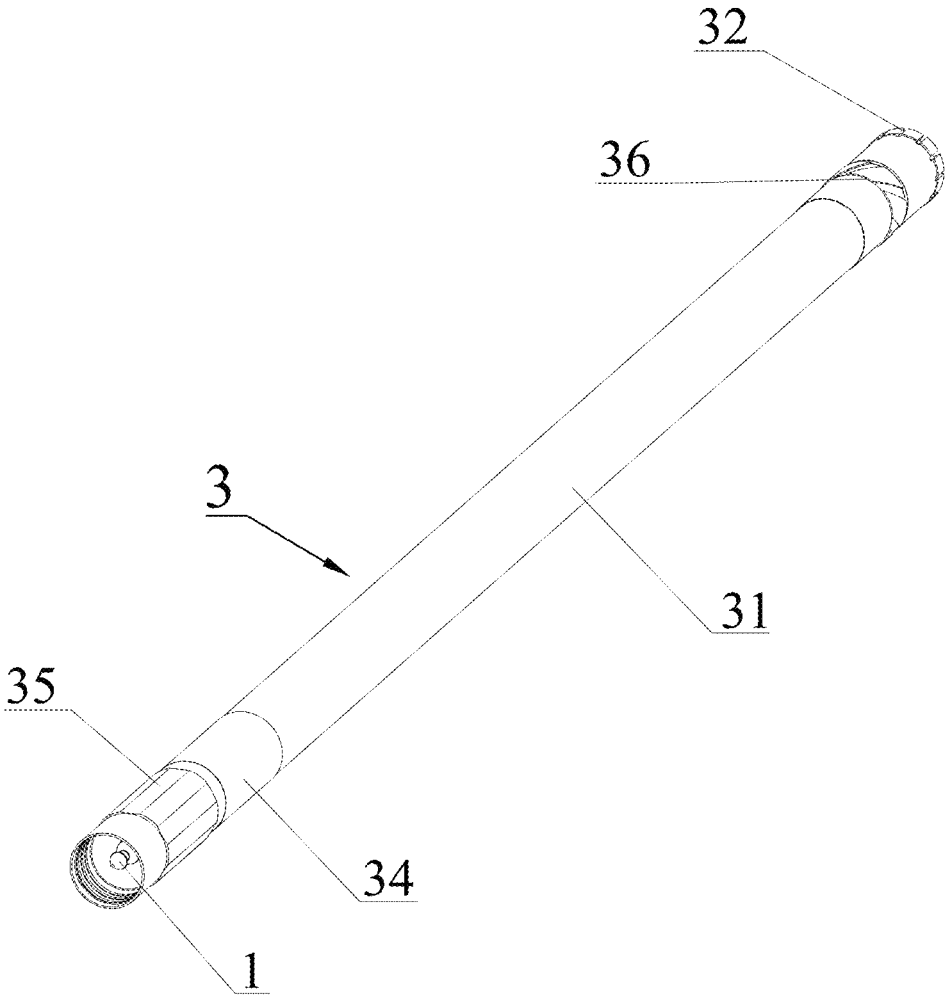
FIG. 4 is a schematic perspective view of a rope coring drill tool in accordance with an embodiment of the present disclosure.
Figure 5:
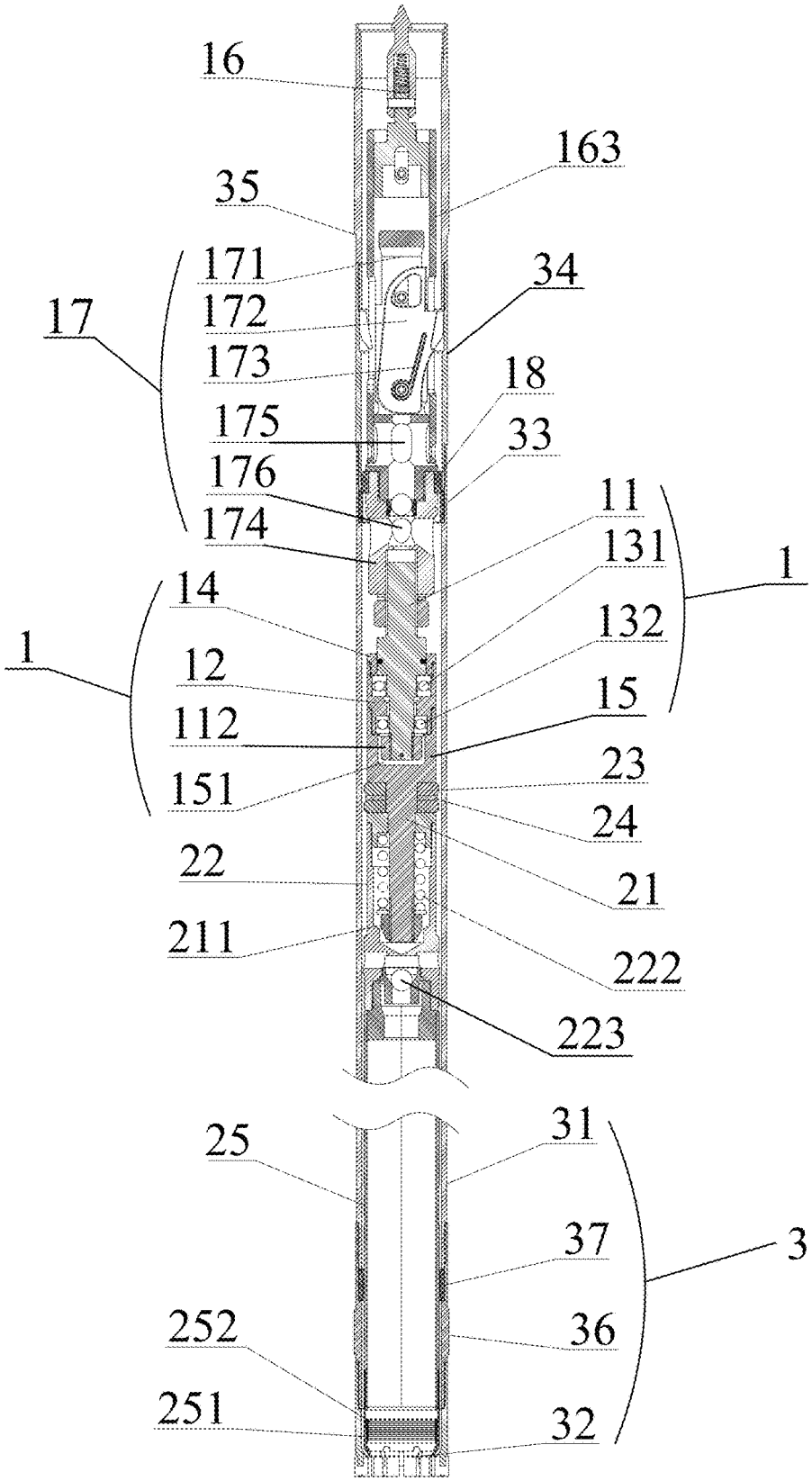
FIG. 5 is a schematic cross-sectional view of a rope coring drill tool in accordance with an embodiment of the present disclosure.

As shown in FIGS. 1, 2 and 3, an inner tube assembly of drill tool includes an inner tube assembly upper part 1*a* and an inner tube assembly lower part 2*a* which are rotatable relatively and connected together through a shaft 11 and a single action mechanism 1 including a bearing block 12 and a thrust ball bearing, the thrust ball bearing 13 is built into a shaft part of the bearing block 12, the shaft 11 is connected to the thrust ball bearing in the bearing block 12, the bearing block 12 is provided with a sealing ring seat 14 sealed with the shaft 11.

The bearing block 12 is provided with an upper shaft part 123 and a lower shaft part 124, the thrust ball bearing includes a thrust bearing 131 and a suspension bearing 132 which are respectively built into the upper shaft part 123 and the lower shaft part 124 of the bearing block 12, the shaft 11 passes through the thrust bearing 131 and the suspension bearing 132 which are in the bearing block 12 and a lock nut 112 is provided at a lower end of the shaft 11.

The upper shaft part 123 of the bearing block 12 is provided an internal thread, and the sealing ring seat 14 is provided with an external thread and is screwed between the upper shaft part 123 and the shaft 11. The lower shaft part 124 of the bearing block 12 is provided with an external thread to which an outer seat 15 is screwed.

The sealing ring seat 14 is provided at an upper edge of the bearing block 12, a spindle 21 is connected at a bottom end of bearing block 12 via the outer seat 15, to form a confined space, the thrust bearing 131 and the suspension bearing 132 are provided in the bearing block 12, to support a rotation of the shaft 11. During drilling, the drilling fluid and the flushing fluid don't enter into the bearing block 12, and don't contact with the thrust bearing 131 and the suspension bearing 132, such that the single action performance of the bearings is not affected. And the seal for the bearing block 12 effectively protects the bearings, extends the service life of the thrust bearing 131 and suspension bearing 132.

In this embodiment, the shaft 11 is provided with a shaft sealing ring 111, and the shaft 11 and the sealing valve seat 36 are sealed by the shaft sealing ring 111. The bearing block 12 is sealed with the sealing ring seat 14 by a first sealing ring 121 and is sealed with the spindle 21 by a second sealing ring 122.

The inner tube assembly lower part 2*a* includes an inner tube lid 22 and a spindle 21, the spindle connects the outer seat 15 with the inner tube lid 22, the inner tube lid 22 is connected with an inner tube 25.

Further, a cap 221 is removably provided on the inner tube lid 22, a lower end of the spindle 21 passes through the cap 221 and extends into the inner tube lid 22, and a compression spring 222 is provided between the cap 221 and a bottom end of the spindle 21. When assembled, the spindle 21 is passed through the cap 221 and extends into the inner tube lid 22, and the cap 221 is mounted on a top end of the inner tube lid 22, to complete the connection of the spindle 21 and the inner tube lid 22. The inner tube lid 22 is used to connect the inner tube. The inner tube lid 22 is provided with a check valve 223 configured to prevent the flushing fluid from entering the inner tube 25 and affecting the storage of the drill cores. During drilling, the drill core enters the inner tube 25, the drilling fluid at the top of the drill core and the top of the inner tube 25 can be discharged unidirectionally from the check valve 223.

The outer seat 15 is provided with a receiving groove 151 configured to receive the shaft 11 and the lock nut 112 which extend out of the bottom end of the bearing block 12, the outer seat 15 is threaded with the bearing block 12, a bottom end of the spindle 21 extends into the inner tube lid 22, and a compression spring 222 is provided between the cap 221 and the bottom end of the spindle 21. The bottom end of the spindle 21 is provided with a blocking nut 211, and the compression spring 222 is provided between the blocking nut 211 and the cap 221.

A location alarm rubber ring 23 and a shim of shutoff valve 24 are provided between a top end of the cap 221 and the spindle 21. During drilling, in the event of drill core plugging or drill core filling the inner tube 25, the drill core creates a pushing force against the inner tube 25, the clamping mechanism 17 limits an upstream position of the inner tube assembly, so that the position alarm rubber ring 23 and the shim of shutoff valve 24 are squeezed by the upward pushing force, the position alarm rubber ring 23 deforms and expands, and reduces or clogs an annulus gap between the inner tube and the outer tube, which makes the flushing fluid be blocked, and if a rise in pressure of the flushing fluid pump is detected, it is determined that the drill core tube is clogged and the drilling for fishing the drill core should be stopped.

The inner tube assembly upper part 1*a* includes a fishing spear mechanism 16, a clamping mechanism 17 and a recovery pipe 163 which are connected in sequence from top to bottom, the single action mechanism 1 is connected to the clamping mechanism 17 through the shaft 11.

The fishing spear mechanism 16 includes a fishing spear head 161 and a fishing spear seat 162, the fishing spear head 161 is movably connected to a fishing spear seat 162, the fishing spear seat 162 is fixedly connected to a recovery tube 163. Upon lifting the inner tube assembly to retrieve the drill core, a fisher is lowered from within the drill pipe to an upper end of the inner tube assembly, the fisher hooks the fishing spear head 161, the fisher is lifted upward and pulls the fishing spear head 161 upward, the fishing spear head 161 lifts the recovery tube 163 upward through the fishing spear seat 162, and the clamping tongs 172 are forced to close, thereby disengaging the inner tube assembly from the outer tube assembly 3, and thereby lifting the inner tube assembly up.

The clamping mechanism 17 includes a clamping holder 171 provided in the recovery tube 163 and clamping tongs 172 provided in the clamping holder 171 by an embedded spring 173, two wings of the clamping tongs 172 extend out of the recovery tube 163 when deployed, a bottom end of the clamping holder 171 is connected with the shaft 11 by a clamping holder lower joint 174. A suspension ring 18 is provided at a top end of the clamping holder lower joint 174.

The clamping tongs 172 are deployed outwardly by the embedded spring 173 to abuts against a bottom end of a clamping chamber 34, to form a clamping state, such that axial movement of the inner tube 25 as it is filled with the drill core during drilling can be prevented. Upon fishing the drill core from the inner tube assembly through the fisher, the fisher pulls the fishing spear mechanism 16, the fishing spear mechanism 16 pulls the recovery tube 163 upward, a side hole 164 provided on a side surface of the recovery tube 163 pushes the clamping tongs 172 upward, so that the clamping tongs 172 close centrally and disengage from the clamping chamber 34, to achieve separation of the inner tube assembly of drill tool from the outer tube 31. The inner tube assembly of drill tool and the inner tube 25 may be lifted out to retrieve the drill core.

A bottom end of the clamping holder 171 is provided with a flushing fluid channel 175, the clamping holder lower joint 174 is provided with a drilling fluid channel 176, and the flushing fluid channel 175 communicates with the drilling fluid channel 176, and a position message sleeve 177 and a freely movable steel ball 178 are provided therebetween.

Referring to FIGS. 1 to 5, a rope coring drill tool including the inner tube assembly of drill tool described in the above detailed embodiment is shown.

The rope coring drill tool further includes an outer tube assembly 3, a drill bit 32 and a reamer 36, the reamer 36 and the drill bit 32 are provided at a bottom end of the outer tube assembly 3, the inner tube assembly of drill tool is mounted in the outer tube assembly 3.

The outer tube assembly 3 includes an outer tube 31, and the reamer 36 and the drill bit 32 are provided at a bottom end of the outer tube 31.

The outer tube assembly 3 includes a clamping chamber 34 and a clamping stop head 35, the clamping stop head 35 abuts against the clamping tongs 172 of the inner tube assembly of drill tool.

A seat ring 33 is provided within the outer tube 31 and the inner tube assembly of drill tool is positionally mounted onto the seat ring 33 through the suspension ring 18.

In an embodiment of the present disclosure, the inner tube assembly of drill tool is firstly connected to the inner tube 25, a bottom end of the inner tube 25 is provided with a clamping spring seat 251 and a clamping spring 252, the inner tube assembly of drill tool, the clamping spring seat 251 and the clamping spring 252 together form the inner tube assembly. The reamer 36 is provided at the bottom end of the outer tube 31 and the drill bit 32 is provided at the bottom end of the reamer 36. A centering ring 37 is provided inside the reamer 36 and is configured to center and guide the inner tube, to keep the inner tube 25 coaxial with the outer tube 31, and facilitate the entry of the drill core into the clamping spring seat 251 and the inner tube 25. The outer tube 31, the clamping chamber 34, the seat ring 33, the centering ring 37, the reamer 36, the drill bit 32, and the clamping stop head 35 together form the outer tube assembly 3.

When in use, the inner tube assembly is mounted in the outer tube assembly 3. As the inner tube assembly is lowered in the outer tube assembly 3, the inner tube assembly is mounted in place when the suspension ring 18 abuts against the seat ring 33, at which point the steel ball 178 passes through the position message sleeve 177 and causes a change in pump pressure, thereby determining that the inner tube assembly is in place. The clamping tongs 172 of the clamping mechanism 17 are deployed by the action of the embedded spring 173, two wings of the clamping tongs 172 extend outward and abuts against a bottom end of the snap head 35, so that the inner tube assembly is positioned in the outer tube assembly 3.

During operation, a drill rig drives a drill pipe (not shown in the drawing) to rotate, the drill pipe is connected to the clamping stop head 35, the clamping stop head 35 is connected to the clamping chamber 34, the clamping chamber 34 is connected to the outer tube 31, so the outer tube 31 is driven to rotate by the drill pipe, the drill bit 32 and reamer 36 provided at a bottom of the outer tube 31 are used to drill. The outer tube 31 drives the drill bit 32 at its bottom to cut the rock, and drives the clamping mechanism 17 to rotate, the outer tube 31 is connected to the shaft 11 through the clamping holder 171 and the clamping holder lower joint 174. The shaft 11 is rotatable in the bearing block 12 through the thrust bearing 131 and the suspension bearing 132, but the bearing block 12, the spindle 21, the inner tube lid 22 and the inner tube 25 do not follow the rotation. Thus, a single action effect is achieved.

During drilling, the flushing fluid and the drilling fluid do not enter the inner of the bearing block 12, and good sealing against the thrust bearing 131 and the suspension bearing 132 is achieved by the isolation of the sealing ring seat 14 and the spindle 21, thereby protecting the single action performance of the bearings. Due to the sealing protection of the thrust bearing 131 and the suspension bearing 132, the present disclosure may be applied in the field of water conservancy and hydropower, engineering survey, rare earth mineral survey etc., to achieve promotion and application.

In conclusion, the present disclosure has been made into actual samples as described in the description and the drawings and has been tested for multiple uses, and from the effect of the use tests, it can be demonstrated that the present disclosure can achieve its intended purpose without doubting the utilitarian value. The above-mentioned embodiments are used merely as a matter of exemplification of the disclosure, it is not intended to limit the disclosure in any form, equivalent embodiments of local changes or modifications made by any person skilled in the art through the technical contents of the present disclosure, without departing from the technical features of the present disclosure, will still fall within the technical features of the present disclosure.

The invention claimed is:

1. An inner tube assembly of drill tool, comprising an inner tube assembly upper part (1*a*) and an inner tube assembly lower part (2*a*) which are rotatable relatively and connected together through a shaft (11) and a single action mechanism (1) comprising a bearing block (12) and a thrust ball bearing (13), wherein the thrust ball bearing (13) is built into a shaft part of the bearing block (12), the shaft (11) is connected to the thrust ball bearing in the bearing block (12), and the bearing block (12) is provided with a sealing ring seat (14) sealed with the shaft (11); and wherein the shaft (11) is provided with a shaft sealing ring (111), and the shaft (11) is sealed with a sealing valve seat (36) by the shaft sealing ring (111).

2. An inner tube assembly of drill tool, comprising an inner tube assembly upper part (1*a*) and an inner tube assembly lower part (2*a*) which are rotatable relatively and connected together through a shaft (11) and a single action mechanism (1) comprising a bearing block (12) and a thrust ball bearing (13), wherein the thrust ball bearing (13) is built into a shaft part of the bearing block (12), the shaft (11) is connected to the thrust ball bearing in the bearing block (12), and the bearing block (12) is provided with a sealing ring seat (14) sealed with the shaft (11); and wherein a lower shaft part (124) of the bearing block (12) is provided with an external thread to which an outer seat (15) is screwed; and wherein the bearing block (12) is sealed with the sealing ring seat (14) by a first sealing ring (121) and is sealed with the outer seat (15) by a second sealing ring (122).

3. An inner tube assembly of drill tool, comprising an inner tube assembly upper part (1*a*) and an inner tube assembly lower part (2*a*) which are rotatable relatively and connected together through a shaft (11) and a single action mechanism (1) comprising a bearing block (12) and a thrust ball bearing (13), wherein the thrust ball bearing (13) is built into a shaft part of the bearing block (12), the shaft (11) is connected to the thrust ball bearing in the bearing block (12), and the bearing block (12) is provided with a sealing ring seat (14) sealed with the shaft (11); and wherein a lower shaft part (124) of the bearing block (12) is provided with an external thread to which an outer seat (15) is screwed; and wherein the inner tube assembly lower part (2*a*) comprises an inner tube lid (22) and a spindle (21), the spindle (21) connects the outer seat (15) with the inner tube lid (22), and the inner tube lid (22) is connected with an inner tube (25).

4. The inner tube assembly of drill tool as claimed in claim 3, wherein a cap (221) is removably provided on the inner tube lid (22), a lower end of the spindle (21) passes through the cap (221) and extends into the inner tube lid (22), and a compression spring (222) is provided between the cap (221) and a bottom end of the spindle (21).

5. The inner tube assembly of drill tool as claimed in claim 1, wherein the inner tube assembly upper part (1*a*) comprises a fishing spear mechanism (16), a clamping mechanism (17) and a recovery pipe (163) which are connected to one another in a direction from top to bottom, and the single action mechanism (1) is connected to the clamping mechanism (17) through the shaft (11); and wherein the clamping mechanism (17) comprises a clamping holder (171) and a clamping tong (172), the clamping holder (171) is provided in the recovery pipe (163), the clamping tong (172) is provided in the clamping holder (171) through an embedded spring (173), two wings of the clamping tong (172) extend out of the recovery pipe (163) when deployed, and a bottom end of the clamping holder (171) is connected to the shaft (11) through a clamping holder lower joint (174); and wherein the bottom end of the clamping holder (171) is provided with a flushing fluid channel (175), the clamping holder lower joint (174) is provided with a drilling fluid channel (176), and the flushing fluid channel (175) is in communication with the drilling fluid channel (176), and a position message sleeve (177) and a freely movable steel ball (178) are provided therebetween.

6. A rope coring drill tool comprising the inner tube assembly of drill tool of claim 1.

7. The rope coring drill tool as claimed in claim 6, further comprising an outer tube assembly (3), a drill bit (32) and a reamer (36), wherein the reamer (36) and the drill bit (32) are disposed at a bottom end of the outer tube assembly (3), the inner tube assembly of drill tool is mounted in the outer tube assembly (3).

8. The rope coring drill tool as claimed in claim 7, wherein the outer tube assembly (3) comprises an outer tube (31), and the reamer (36) and the drill bit (32) are provided at a bottom end of the outer tube (31).

9. The rope coring drill tool as claimed in claim 8, wherein the outer tube assembly (3) comprises a clamping chamber (34) and a clamping stop head (35), the clamping stop head (35) abuts against a clamping tong (172) of the inner tube assembly of drill tool.

10. The rope coring drill tool as claimed in claim 8, wherein a seat ring (33) is provided within the outer tube (31) and the inner tube assembly of drill tool is positionally mounted onto the seat ring (33) through a suspension ring (18).

11. The inner tube assembly of drill tool as claimed in claim 1, wherein the bearing block (12) is provided with an upper shaft part (123) and a lower shaft part (124), the thrust ball bearing comprises a thrust bearing (131) and a suspension bearing (132) which are respectively built into the upper shaft part (123) and the lower shaft part (124) of the bearing block (12), the shaft (11) passes through the thrust bearing (131) and the suspension bearing (132) which are in the bearing block (12) and a lock nut (112) is provided at a lower end of the shaft (11).

12. The inner tube assembly of drill tool as claimed in claim 11, wherein the upper shaft part (123) of the bearing block (12) is provided an internal thread, and the sealing ring seat (14) is provided with an external thread and is screwed between the upper shaft part (123) and the shaft (11).

13. The inner tube assembly of drill tool as claimed in claim 11;

wherein the lower shaft part (124) of the bearing block (12) is provided with an external thread to which an outer seat (15) is screwed.

14. The inner tube assembly of drill tool as claimed in claim 12, wherein the bearing block (12) is sealed with the sealing ring seat (14) by a first sealing ring (121) and is sealed with the outer seat (15) by a second sealing ring (122).

15. The inner tube assembly of drill tool as claimed in claim 12, wherein the inner tube assembly lower part (2*a*) comprises an inner tube lid (22) and a spindle (21), the spindle (21) connects the outer seat (15) with the inner tube lid (22), and the inner tube lid (22) is connected with an inner tube (25).

16. The inner tube assembly of drill tool as claimed in claim 15, wherein a cap (221) is removably provided on the inner tube lid (22), a lower end of the spindle (21) passes through the cap (221) and extends into the inner tube lid (22), and a compression spring (222) is provided between the cap (221) and a bottom end of the spindle (21).

17. The inner tube assembly of drill tool as claimed in claim 1, wherein the inner tube assembly upper part (1*a*) comprises a fishing spear mechanism (16), a clamping mechanism (17) and a recovery pipe (163) which are connected to one another in a direction from top to bottom, and the single action mechanism (1) is connected to the clamping mechanism (17) through the shaft (11).

18. The inner tube assembly of drill tool as claimed in claim 17, wherein the clamping mechanism (17) comprises a clamping holder (171) and a clamping tong (172), the clamping holder (171) is provided in the recovery pipe (163), the clamping tong (172) is provided in the clamping holder (171) through an embedded spring (173), two wings of the clamping tong (172) extend out of the recovery pipe (163) when deployed, a bottom end of the clamping holder (171) is connected to the shaft (11) through a clamping holder lower joint (174).

19. The inner tube assembly of drill tool as claimed in claim 18, wherein a top end of the clamping holder lower joint (174) is provided with a suspension ring (18).

20. The inner tube assembly of drill tool as claimed in claim 18, wherein the bottom end of the clamping holder (171) is provided with a flushing fluid channel (175), the clamping holder lower joint (174) is provided with a drilling fluid channel (176), and the flushing fluid channel (175) is in communication with the drilling fluid channel (176), and a position message sleeve (177) and a freely movable steel ball (178) are provided therebetween.

* * * * *